US009695553B2

(12) United States Patent
Kendrick, Jr.

(10) Patent No.: US 9,695,553 B2
(45) Date of Patent: Jul. 4, 2017

(54) MODULAR RAILROAD TRACK ASSEMBLY

(71) Applicant: Claude R Kendrick, Jr., Lanexa, VA (US)

(72) Inventor: Claude R Kendrick, Jr., Lanexa, VA (US)

( * ) Notice: Subject to any disclaimer, the term of this patent is extended or adjusted under 35 U.S.C. 154(b) by 236 days.

(21) Appl. No.: 14/730,384

(22) Filed: Jun. 4, 2015

(65) Prior Publication Data

US 2016/0083910 A1 Mar. 24, 2016

Related U.S. Application Data

(60) Provisional application No. 62/053,896, filed on Sep. 23, 2014.

(51) Int. Cl.

| | |
|---|---|
| ***E01B 3/00*** | (2006.01) |
| ***E01B 3/12*** | (2006.01) |
| ***E01B 3/22*** | (2006.01) |
| ***E01B 3/38*** | (2006.01) |

(52) U.S. Cl.

CPC ..... *E01B 3/12* (2013.01); *E01B 3/22* (2013.01); *E01B 3/38* (2013.01)

(58) Field of Classification Search

CPC ..... E01B 3/00; E01B 3/12; E01B 3/16; E01B 3/20; E01B 3/38; E01B 3/22; E01B 3/48; E01B 9/00; E01B 1/007; E01B 13/00

See application file for complete search history.

(56) References Cited

U.S. PATENT DOCUMENTS

| | | | | | |
|---|---|---|---|---|---|
| 901,316 | A * | 10/1908 | Bergquist | E01B 3/16 | 238/288 |
| 1,266,139 | A * | 5/1918 | Monday | E01B 3/16 | 238/63 |
| 1,586,052 | A * | 5/1926 | Snyder | E01B 3/16 | 238/61 |
| 6,230,981 | B1 * | 5/2001 | Hill | E01B 3/16 | 238/54 |

* cited by examiner

*Primary Examiner* — Mark Le
(74) *Attorney, Agent, or Firm* — Peter J. Van Bergen

(57) ABSTRACT

A modular railroad track assembly includes spaced-apart cross-ties, side ties, and railroad track rails. Each cross-tie includes a planar edge with the cross-ties being arranged such that each planar edge lies in a common plane. The sides of each cross-tie define an acute angle with the cross-tie's planar edge. The acute angle is in the approximate range of 65° to 80°. Railroad track rails are coupled to the planar edge associated with each cross-tie. A first side tie is coupled to first sides of the cross-ties wherein at least a portion of the first side tie is at the acute angle with respect to the planar edges associated with the cross-ties. A second side tie is coupled to second sides of the cross-ties, wherein at least a portion of the second side tie is at the same acute angle with respect to the planar edges associated with the cross-ties.

6 Claims, 8 Drawing Sheets

MODULAR RAILROAD TRACK ASSEMBLY

Pursuant to 35 U.S.C. §119, the benefit of priority from provisional application 62/053,896, with a filing date of Sep. 23, 2014, is claimed for this non-provisional application.

FIELD OF THE INVENTION

The invention relates generally to railroad track construction, and more particularly to a modular railroad track assembly.

BACKGROUND OF THE INVENTION

Transportation of goods and people using railroads has proven to be efficient and cost-effective. A railroad's three basic elements (i.e., tracks, ties and stone beds) have remained substantially unchanged over the years. Railroad construction using these elements is a laborious process. Further, a railroad's elements require maintenance to provide for a train's safe and efficient passage. Unfortunately, conventional railroad construction and maintenance are time-consuming and costly thereby impacting the efficiencies and cost-effectiveness of railroad transportation.

SUMMARY OF THE INVENTION

Accordingly, it is an object of the present invention to provide a railroad track assembly that simplifies railroad construction and maintenance.

Other objects and advantages of the present invention will become more obvious hereinafter in the specification and drawings.

In accordance with the present invention, a modular railroad track assembly includes a plurality of spaced-apart cross-ties, side ties, and a pair of railroad track rails. Each cross-tie includes a planar edge with the plurality of cross-ties being arranged such that each planar edge lies in a common plane. Each cross-tie has a first side and second side. Each of the first side and second side define an acute angle with the cross-tie's planar edge. The acute angle is in the approximate range of 65° to 80°. The railroad track rails are coupled to the planar edge associated with each cross-tie such that the railroad track rails are parallel to one another. A first side tie is coupled to each first side of the cross-ties wherein at least a portion of the first side tie is at the acute angle with respect to the planar edges associated with the cross-ties. A second side tie is coupled to each second side of the cross-ties, wherein at least a portion of the second side tie is at the same acute angle with respect to the planar edges associated with the cross-ties.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
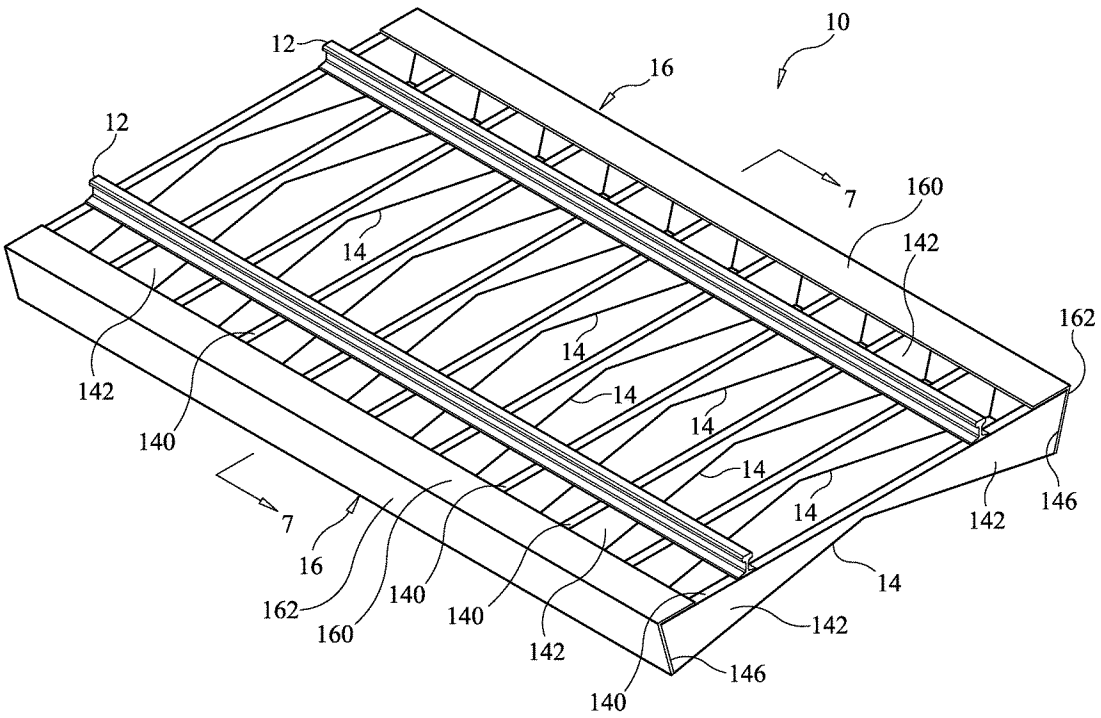
FIG. 1 is a perspective view of a modular railroad track assembly in accordance with an embodiment of the present invention.
Figure 2:
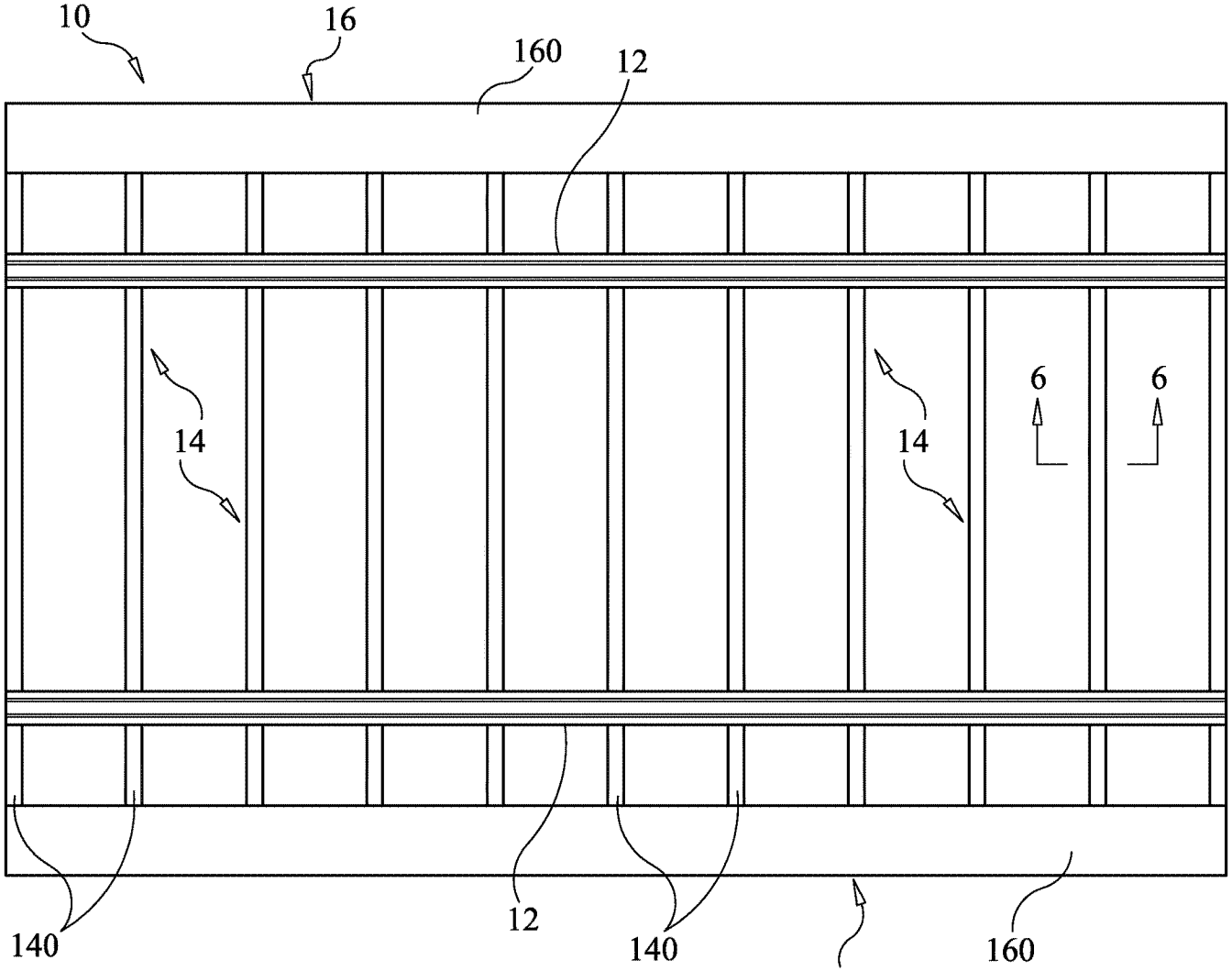
FIG. 2 is a top plan view of the modular railroad track assembly.
Figure 3:
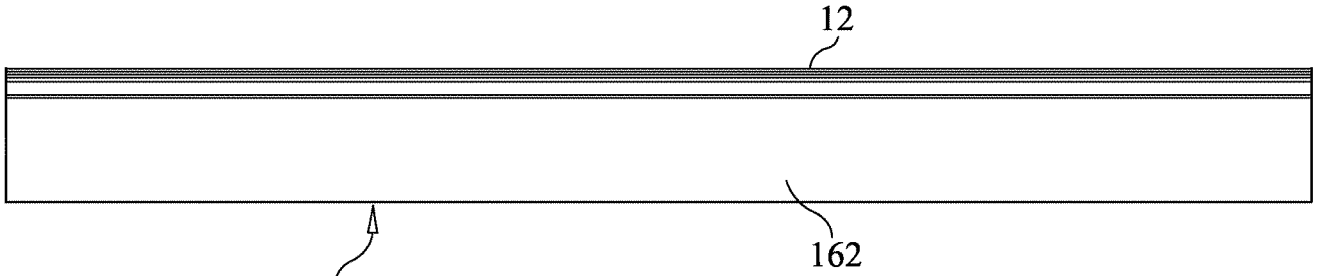
FIG. 3 is a side view of the modular railroad track assembly.
Figure 4:
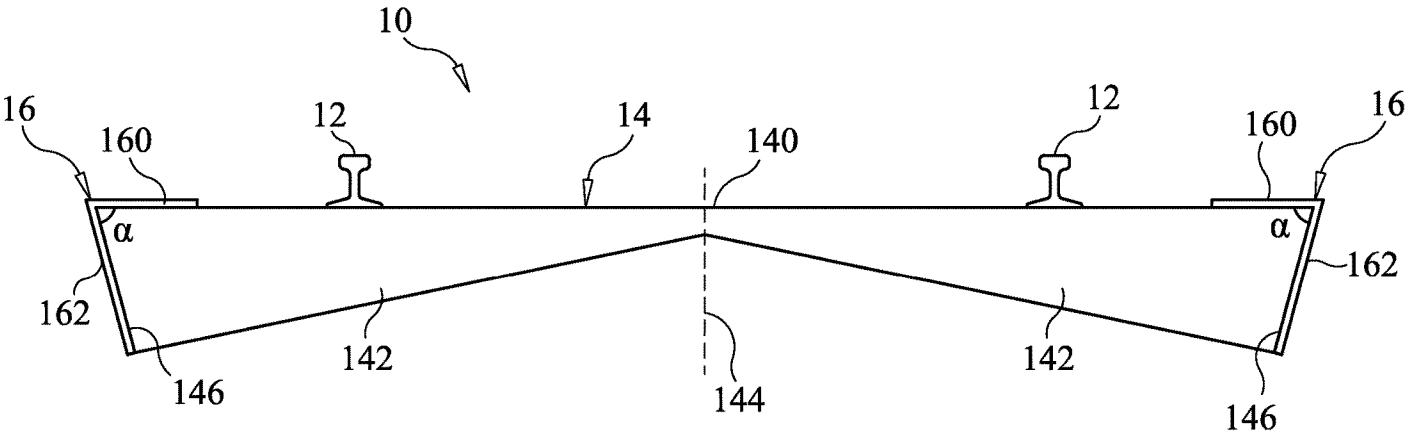
FIG. 4 is an end view of the modular railroad track assembly.
Figure 5:
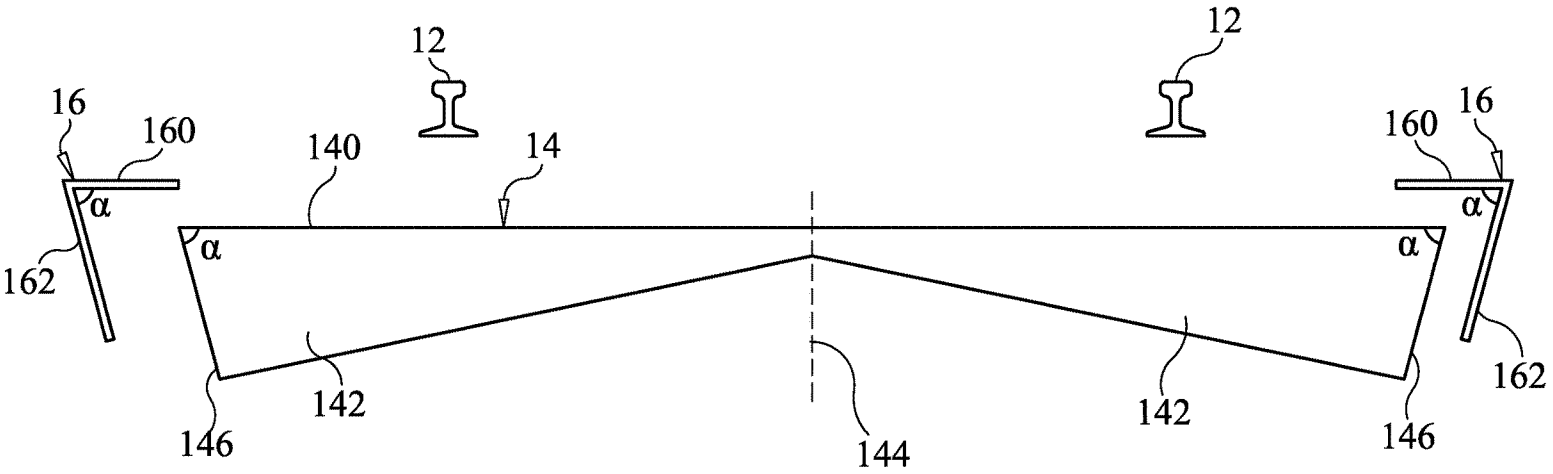
FIG. 5 is an isolated exploded illustration of the end view shown in FIG. 4.
Figure 6:
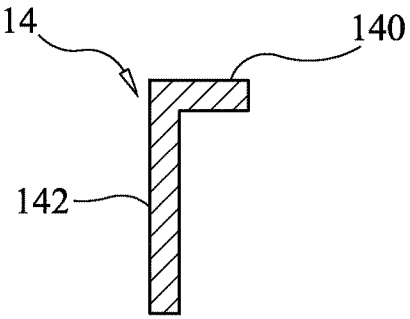
FIG. 6 is a cross-sectional view of a cross-tie taken along line 6-6 in FIG. 2.

Referring now to the drawings, simultaneous reference will be made to FIGS. 1-6 where various views of a modular railroad track assembly in accordance with an embodiment of the present invention are presented in FIGS. 1-5, and a cross-sectional view of one of the assembly's cross-ties is presented in FIG. 6. The modular railroad track assembly is referenced generally by numeral 10.

In general, assembly 10 is a unified assembly that defines a portion of a railroad track that can be fabricated off-site and then transported to a site where railroad track construction or maintenance is to occur. Accordingly, assembly 10 will benefit from the efficiencies, quality, and uniformity achievable in a factory setting. Assembly 10 can be sized (in terms of its length) for efficient shipping/trucking to a railroad construction site. For example, the length of assembly 10 could be approximately 20-40 feet such that multiple ones of assembly 10 could be stacked on a tractor trailer's bed. Once on site, multiples of assembly 10 can be laid out end-to-end and joined together in a variety of ways without departing from the scope of the present invention.

Assembly 10 includes two parallel rails 12, a plurality of spaced-apart cross-ties 14, and two side ties 16. Each of rails 12 is configured as a conventional railroad track rail whose construction and dimensions are well known in the art. Each rail 12 runs perpendicular to cross-ties 14 (i.e., cross-ties 14 are parallel to one another) and will generally be continuous along the length of assembly 10. The distance between rails 12 is well known in the art. Materials used for rails 12, cross-ties 14, and side ties 16 are rigid materials that can be joined together (e.g., welded) or integrated with one another in ways known in the art.

In the illustrated embodiment, each of cross-ties 14 is identical and is generally L-shaped in cross-section (FIG. 6) along its length (i.e., in a direction perpendicular to rails 12). Each cross-tie 14 has a planar base edge or top 140 forming the support base for a portion of each rail 12 and a planar leg 142 forming a portion of the vertical support for assembly 10 as will be explained further below. All planar tops 140 lie in the same plane for support of rails 12. As best illustrated in FIGS. 4 and 5, the profile or side view of each cross-tie 14 is defined by two generally identical triangular portions that meet before their smallest-angle triangle apex at the center line 144 of cross-tie 14 such that the height of leg 142 is smallest at center line 144. That is, the two substantially triangular portions are mirror imaged about center line 144. Each triangular portion has planar top 140 as one side thereof such that planar top 140 is contiguous along cross-tie 14. Each side 146 of cross-tie 14 forms an acute angle α with planar top 140. The angle α is in the approximate range of 65° to 80°. Spacing between cross-ties 14 can be designed/selected to satisfy structural loading, installation requirements, and post-installation stability. Sides 146 at either side of assembly 10 are aligned with one another along the length of assembly 10.

Each side tie 16 is positioned at sides 146 of the series of cross-ties 14 in assembly 10, and is coupled thereto. For example, in the illustrated embodiment, each side tie 16 has a planar top 160 coupled to the cross-ties' planar tops 140, and has a side 162 coupled to one of the two series of sides 146 of cross-ties 14. Accordingly, planar tops 160 and side 162 meet to define the same angle α defined by each cross-tie 14 as described above. That is, each of sides 146 and 162 "toes in" at acute angle α towards center line 144. Each side tie 16 is monolithic in construction and spans all of the assembly's cross-ties 14. In an exemplary embodiment, sides 146 at each side of assembly 10 are aligned such that side ties 16 are parallel to each other and to rails 12.

As mentioned above, materials used to construct cross-ties 14 and side ties 16 are generally rigid and strong, and can include metals, composites and combinations thereof. Each cross-tie 14 and side tie 16 can be a forged or extruded unit or could be a unified assembly without departing from the scope of the present invention. Cross-ties 14 are coupled/joined to side ties 16 in any of a variety of ways known and understood in the art such the combination of cross-ties 14 and side ties 16 define a rigid assembly. Rails 12 are coupled to planar tops 140 of cross-ties 14 to thereby define assembly 10. Attachment of rails 12 to cross-ties 14 can be accomplished in a variety of ways without departing from the scope of the present invention.

Figure 7:
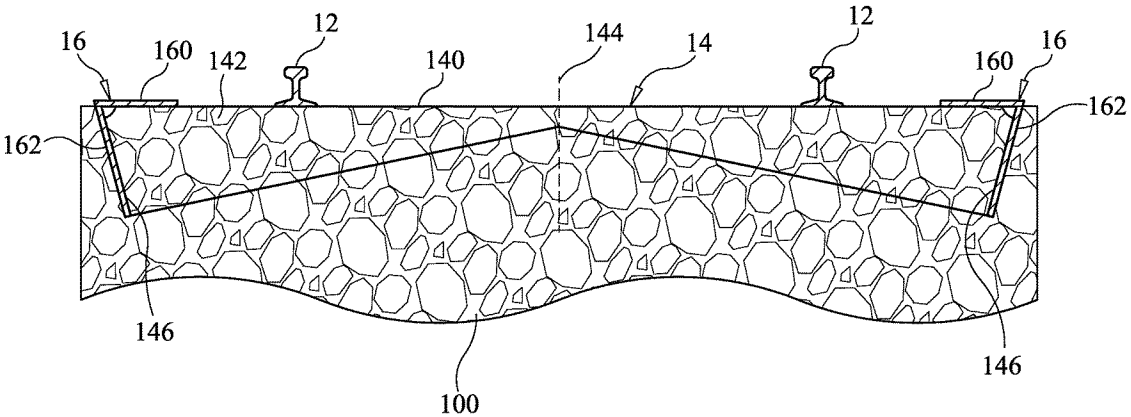
FIG. 7 is a cross-sectional view of the modular railroad track assembly taken along line 7-7 in FIG. 1 and installed in a stone bed.

Referring now to FIG. 7, a cross-sectional view of assembly 10 is shown installed in a stone bed 100 that forms the support base for assembly 10. Stone bed 100 is of a type and construction known in the art of conventional railroad track construction. Assembly 10 can be positioned on and pressed into stone bed 100 until stone bed 100 is in contact with the underside of planar tops 140 of cross-ties 14. The spacing between cross-ties 14 locks assembly 10 in its lengthwise dimension to stone bed 100. The toed-in angle defined by side ties 16 locks assembly 10 in its widthwise dimension to stone bed 100. The toed-in side ties 16 in combination with adjacent cross-ties 14 define bounded regions or compartments (e.g., one such compartment 10A is shown in FIG. 7) that stabilize assembly 10 and the portion of stone bed 100 under assembly 10 each time a train rides over assembly 10. Briefly, as a train's weight presses down on assembly 10, each compartment 10A defined by assembly 10 prevents shifting of the portion of stone bed 100 contained thereby. By retaining stone bed 100 within/under assembly 10, the present invention prevents a gradual deterioration of the support provided by stone bed 100 that is immediately beneath assembly 10.

Figure 8:
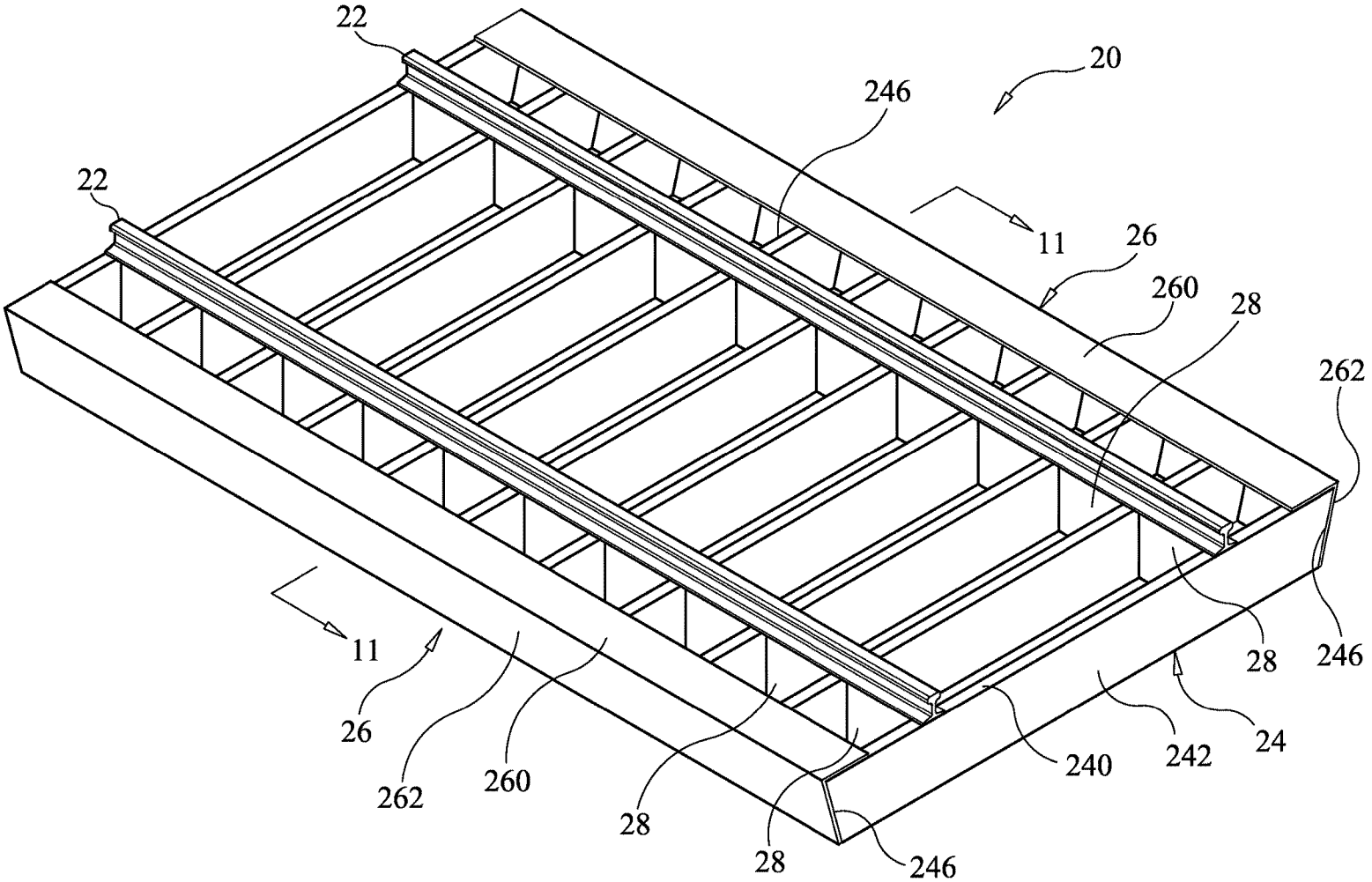
FIG. 8 is a perspective view of a modular railroad track assembly in accordance with another embodiment of the present invention.

Another embodiment of a modular railroad track assembly in accordance with the present invention will now be described with the aid of FIGS. 8-12 where the entire assembly is referenced by numeral 20 in FIG. 8. Similar to assembly 10 described above, assembly 20 is a unified assembly made from rigid materials that defines a portion of a railroad track that can be fabricated off-site and transported to a railroad's construction or maintenance site. Assembly 20 includes two rails 22, a plurality of spaced-apart cross-ties 24, two side ties 26, and a plurality of intermediate ties 28. Rails 22 and side ties 26 are identical in structure and function to the previously-described rails 12 and side ties 16, respectively, and will not be described further herein.

Figure 9:
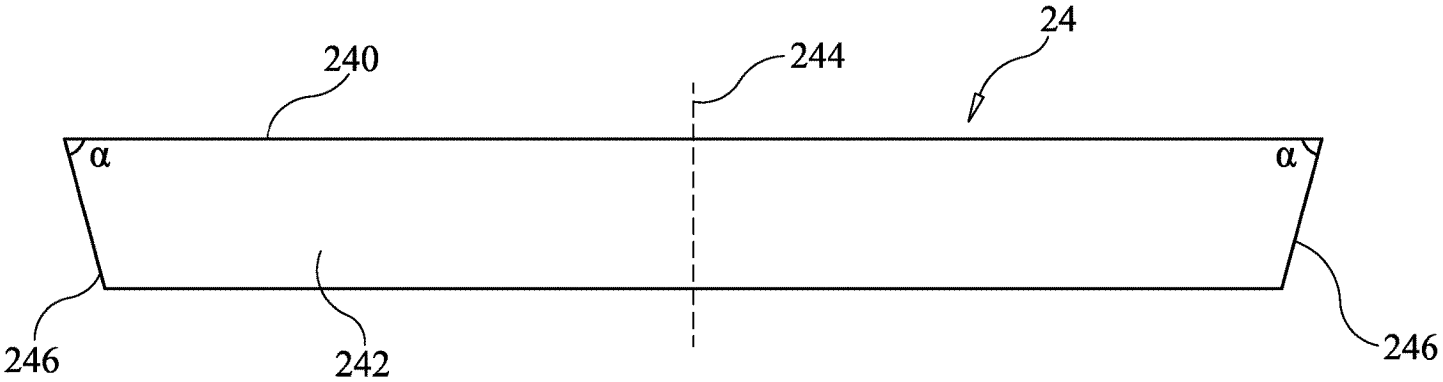
FIG. 9 is an isolated side view of a cross-tie from the embodiment illustrated in FIG. 8.
Figure 10:
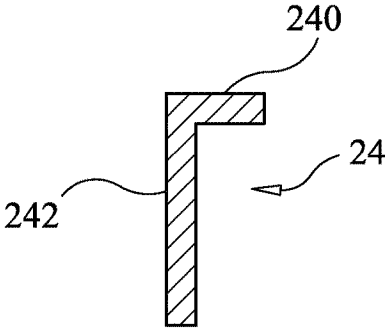
FIG. 10 is a cross-sectional view of a cross-tie in the embodiment illustrated in FIG. 8.

An isolated side view of one of cross-ties 24 is illustrated in FIG. 9 and a cross-sectional view thereof is illustrated in FIG. 10. Cross-tie 24 is L-shaped in cross-section all along its length. Cross-tie 24 has a planar top 240 to which rails 22 are coupled, and a planar leg 242 defined by an inverted isosceles trapezoid whose base angles are defined by the above-described acute angle α. That is, each side 246 of cross-tie 24 forms acute angle α with top 240 to thereby toe-in sides 246 towards a center line 244 of cross-tie 24. Toe-in angle α is in the approximate range of 65° to 80° as described above for assembly 10.

Figure 11:
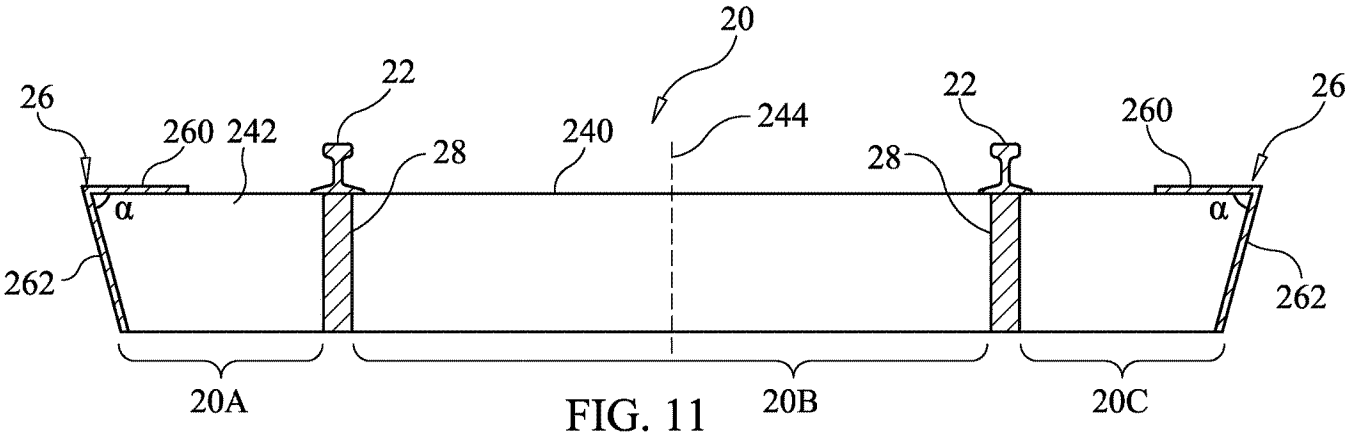
FIG. 11 is a cross-sectional view of the modular railroad track assembly taken along line 11-11 in FIG. 8.
Figure 12:
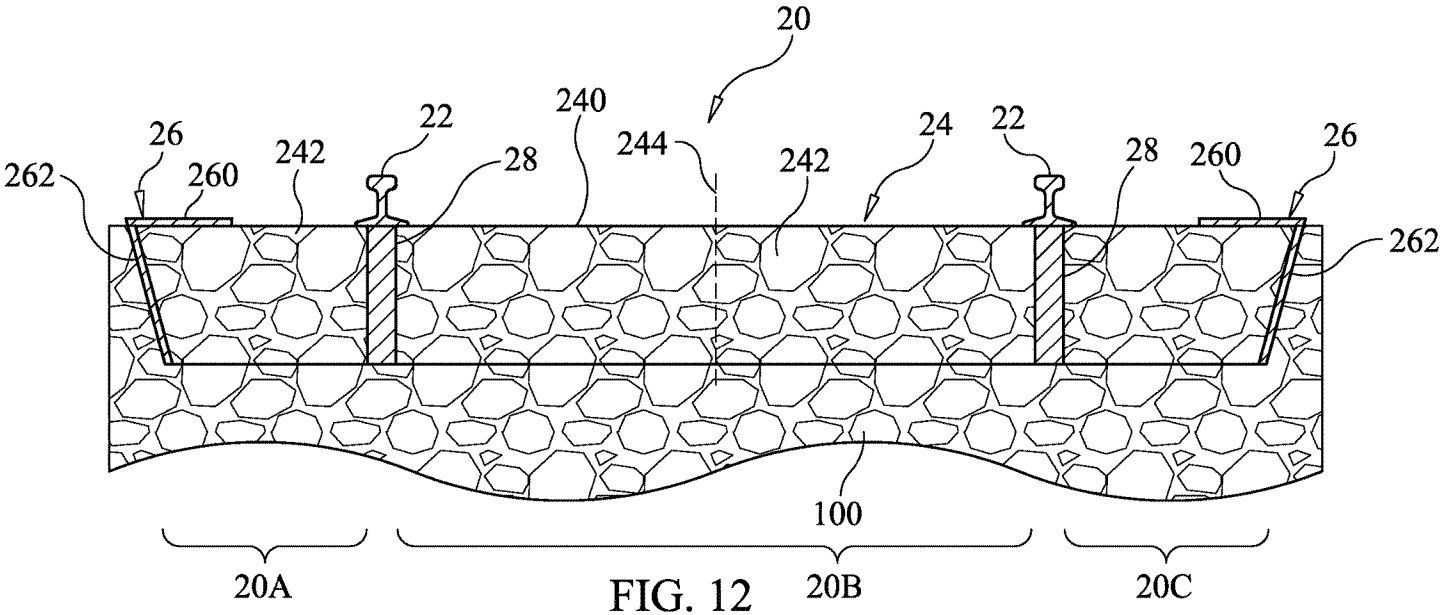
FIG. 12 is a cross-sectional view of the modular railroad track assembly taken along line 11-11 in FIG. 8 and installed in a stone bed.

Referring additionally now to FIGS. 11 and 12, each intermediate tie 28 is a generally rectangular plate spanning and coupled to two cross-ties 24, and aligned with (i.e., beneath) and supporting a portion of one of rails 22. The addition of intermediate ties 28 provides two functions. First, intermediate ties 28 in combination with cross-ties 24 define a continuum of vertical support directly under each rail 22. Second, the inclusion of intermediate ties 28 divides the volume between adjacent ones of cross-ties 24 that is bounded by side ties 26 into three compartments 20A, 20B and 20C. That is and as illustrated in FIG. 12, once assembly 20 is installed in stone bed 100, portions of the stone bed are locked into each of compartments 20A, 20B and 20C defined between adjacent ones of cross-ties 24 as bounded by side ties 26. As a result, once assembly 20 is installed in stone bed 100, compartments 20A-20C greatly reduce or eliminate any shifting of stone bed 100 beneath assembly 20.

The advantages of the present invention are numerous. The modular railroad track assembly will provide unprecedented quality control in railroad track construction via consistent factory assemblies. The modular design will simplify construction/maintenance of railroad tracks and greatly reduce off-line time for a railway line. The assembly's toed-in sides and compartmentalized engagement of the underlying stone bed locks the assembly to the stone bed during installation and during the life of the assembly even as a train passes over thereby reducing the frequency of track maintenance.

Although the invention has been described relative to a specific embodiment thereof, there are numerous variations and modifications that will be readily apparent to those skilled in the art in light of the above teachings. For example, each cross-tie could be a plate whose one edge defines the planar top onto which the rails are mounted. Similarly, each side tie could be a plate that is coupled to the sides of the cross-ties. It is therefore to be understood that, within the scope of the appended claims, the invention may be practiced other than as specifically described.

What is claimed as new and desired to be secured by Letters Patent of the United States is:

1. A modular railroad track assembly, comprising:

a plurality of spaced-apart cross-ties, each of said cross-ties including a planar edge, said plurality of cross-ties arranged with each said planar edge in a common plane, each of said cross-ties having a first side and second side, each of said first side and said second side defining an acute angle with said planar edge, said acute angle being in the approximate range of 65° to 80°;

a pair of railroad track rails, each of said railroad track rails coupled to said planar edge associated with each of said cross-ties wherein said railroad track rails are parallel to one another;

a first side tie coupled to said first side of each of said cross-ties, wherein at least a portion of said first side tie is at said acute angle with respect to said planar edge associated with said cross-ties; and a second side tie coupled to said second side of each of said cross-ties, wherein at least a portion of said second side tie is at said acute angle with respect to said planar edge associated with said cross-ties, wherein a plurality of compartments are defined within said railroad track assembly, each of said compartments defined between adjacent ones of said cross-ties, a portion of said first side tie, and a portion of said second side tie.

2. A modular railroad track assembly as in claim 1, further comprising an intermediate tie spanning between said adjacent ones of said cross-ties and aligned with one of said railroad track rails.

3. A modular railroad track assembly as in claim 1, wherein said cross-ties are parallel to one another.

4. A modular railroad track assembly as in claim 1, wherein each of said railroad track rails is perpendicular to each of said cross-ties.

5. A modular railroad track assembly as in claim 2, wherein three of said compartments are defined between said adjacent ones of said cross-ties.

6. A modular railroad track assembly as in claim 2, wherein said first side tie and said second side tie are parallel to said railroad track rails.

* * * * *